US006036137A

United States Patent [19]

Myren

[11] Patent Number: 6,036,137

[45] Date of Patent: Mar. 14, 2000

[54] APPARATUS AND METHOD FOR WINDING PAPER

[75] Inventor: H. Ingemar Myren, Karlstad, Switzerland

[73] Assignee: Valmet-Karlstad AB, Sweden

[21] Appl. No.: 09/215,024

[22] Filed: Dec. 17, 1998

[51] Int. Cl.[7] ..... B65H 18/14

[52] U.S. Cl. ..... 242/541.7; 242/541.4; 242/534

[58] Field of Search ..... 242/541.7, 541.4, 242/534

[56] References Cited

U.S. PATENT DOCUMENTS

| | | | |
|---|---|---|---|
| 3,687,388 | 8/1972 | Pfeiffer | 242/534 |
| 4,552,317 | 11/1985 | Halter | 242/541.7 |
| 4,634,068 | 1/1987 | Malkki et al. | 242/541.7 |
| 4,921,183 | 5/1990 | Saukkonen et al. | 242/541.7 X |
| 5,267,703 | 12/1993 | Biagiotti | 242/541.7 |
| 5,285,979 | 2/1994 | Lombardini | 242/541.7 |
| 5,308,008 | 5/1994 | Ruegg | 242/541.7 |
| 5,393,008 | 2/1995 | Kyytsonen et al. | 242/541.4 X |
| 5,611,500 | 3/1997 | Smith . | |
| 5,664,737 | 9/1997 | Johnson et al. | 242/534 X |
| 5,820,065 | 10/1998 | Altosaar et al. | 242/534 |

FOREIGN PATENT DOCUMENTS

| | | | |
|---|---|---|---|
| 0502434A1 | 2/1992 | European Pat. Off. . | |
| 57-141338 | 9/1982 | Japan | 242/534 |
| WO 97/22543 | 6/1997 | WIPO . | |

OTHER PUBLICATIONS

Nobel Electroni AB brochure, "Accurate Weighing Overload Protection in Lifting Devices", 2 pages, Dec. 1997.

MTS Sensor Technologie brochure, "Temposonics—III Sensor CANbus", 12 pages, undated.

MTS Sensor Technologie brochure, "Magnetostrictive Position Sensors Linear and Absolute—Temposonics–LH for Hydraulic Cylinders", 6 pages, undated.

*Primary Examiner*—Donald P. Walsh
*Assistant Examiner*—Minh-Chau Pham
*Attorney, Agent, or Firm*—Alston & Bird LLP

[57] ABSTRACT

Apparatus and method for winding paper onto a parent roll includes a rotatable reel spool onto which the paper web is wound and a reel drum over which the paper web is guided and which contacts the parent roll to form a nip at which the paper is wound onto the parent roll. In one embodiment, sensors are used for determining the indented thickness of the parent roll at the nip and the unindented thicknesses of the parent roll spaced from the nip, from which a radial indentation is derived. A control relatively positions the reel spool and reel drum to maintain the radial indentation within predetermined limits. In another embodiment of the invention, control of linear nip load is accomplished by measuring a diameter of the paper roll and a force indicative of linear nip load, and controlling relative positioning of the reel spool and reel drum to maintain the force within predetermined limits that are based on the diameter of the roll.

27 Claims, 3 Drawing Sheets

APPARATUS AND METHOD FOR WINDING PAPER

FIELD OF THE INVENTION

The present invention relates to papermaking and, more particularly, to apparatus and methods for winding paper onto a parent roll during a papermaking process.

BACKGROUND OF THE INVENTION

During the manufacture of paper, a dried web of paper coming from a dry end section of a papermaking apparatus is initially wound on a reel spool to form a parent roll which typically is temporarily stored for further processing. Subsequently, the parent roll is unwound and the web of paper is converted into a final product form.

In winding the paper web into a large parent roll, it is vital that the roll be wound in a manner which prevents major defects in the roll and which permits efficient conversion of the roll into the final product, whether it be boxes of facial tissue sheets, rolls of bath tissue, rolls of embossed paper towels, and the like. Ideally, the parent roll has an essentially cylindrical form, with a smooth cylindrical major surface and two smooth, flat, and parallel end surfaces. The cylindrical major surface and the end surfaces should be free of ripples, bumps, waviness, eccentricity, wrinkles, etc., or, in other words, the roll should be "dimensionally correct." Likewise, the form of the roll must be stable, so that it does not depart from its cylindrical shape during storage or routine handling, or, in other words, the roll should be "dimensionally stable." Defects can force entire rolls to be scrapped if they are rendered unsuitable for high speed conversion.

Many defects can be introduced by improper winding of the paper web onto the parent roll, especially when winding high bulk, easily-compressible, soft tissue webs. A large number of such defects are discussed and shown in photographs in an article by W. J. Gilmore, "Report on Roll Defect Terminology - TAPPI CA1228," Proc. 1973 Finishing Conference, Tappi, Atlanta, Ga., 1973, pp. 5–19. Inadequate web stress near the core of the roll may cause the outer regions of the roll to compress the roll inwardly, leading to buckling in a starred pattern, commonly called "starring", as described by James K. Good, "The Science of Winding Rolls", *Products of Papermaking, Trans. of the Tenth Fundamental Research Symposium at Oxford,* September 1993, Ed. C. F. Baker, Vol. 2, Pira International, Leatherhead, England, 1993, pp. 855–881. Furthermore, starring causes the release of the tension of the web around the core that normally provides sufficient friction between the core and adjacent layers of the web. This loss of friction can result in core "slipping" or "telescoping", where most of the roll (except for a few layers around the core and a few layers around the outermost regions) moves en masse to one side with respect to the axis of the roll, rendering the roll unusable.

Current commercially available hard nip drum reels of the type with center-assisted drives, as described by T. Svanqvist, "*Designing a Reel for Soft Tissue",* 1991 Tissue Making Seminar, Karlstad, Sweden, have been successfully used to wind rolls of compressible tissue webs having bulks of up to about 8 to 10 cubic centimeters per gram, while avoiding the above-mentioned winding problems, by reducing the nip force and relying mainly on the in-going web tension control through modulation of the center-assisted drive for the coreshaft. However when using such methods to wind tissue sheets having bulk of 9 cubic centimeters per gram or higher and a high level of softness, as characterized, for example, by an MD Max Slope of about 10 kilograms or less per 3 inches of sample width, these problems will recur. These winding problems are accentuated when attempting to wind large rolls with diameters from about 70 inches to about 150 inches or greater, particularly at high speeds.

Without wishing to be bound by theory, it is believed that when a web is brought into a nip formed between the parent roll and a pressure roll, two major factors besides the in-going web tension affect the final stresses inside a wound roll. Firstly, the portion of the parent roll in the nip is deformed to a radius which is smaller than the undeformed radius of the parent roll. The expansion of the parent roll from its deformed radius to its undeformed radius stretches the web and results in a substantial internal tension increase from the set tension of the web going into the nip.

Another factor is sometimes called the "secondary winding" effect. A portion of the web is added to a roll after it passes first through the nip between the parent roll and the pressure roll. It then passes under the nip repeatedly at each rotation of the parent roll while more layers are added on the outer diameter. As each point near the surface of the roll reenters the nip, the web is compressed under the nip pressure, causing air in the void volume of the web to be expelled between the layers. This can reduce the friction between the layers sufficiently to allow the layers to slide tighter around the inner layers, as described by Erickkson et al., *Deformations in Paper Rolls,* pp. 55–61 and Lemke, et al., *Factors involved in Winding Large Diameter Newsprint Rolls on a Two-Drum Winder,* pp 79–87 Proc. of the *First International Conference on Winding Technology,* 1987.

The tension in each layer as it is added to the parent roll causes a compression force exerted by the outer layer to the layers underneath, and thus the cumulative effect of compression from the outer layers will normally cause the web at the region around the core to have the highest interlayer pressure. The secondary winding further adds to this pressure. Soft tissue is known to yield when subjected to compression, thus absorbing some of the increases in pressure to the extent that it loses its ability to deform. Consequently, the cumulative pressure can rise at a steep rate to excessive levels that can cause a wide variation in the sheet properties unwound from the parent rolls.

Unfortunately, the internal pressure and web tension gradient that exists along the radius of a conventionally wound parent roll, while successful in preventing dimensional stability problems, can lead to undesired variability in the properties of the web. High tension in some regions causes some of the machine direction stretch to be pulled out during winding, and high internal pressure results in loss of bulk. Upon unwinding, regions that have been stretched more by high tension in and after the nip will have lower basis weight because of longitudinal stretching of the web. These changes in crucial web properties lead to variability in product quality and difficulties in converting operations.

Compensating for the internal pressure build-up, according to the above-mentioned method described by T. Svanqvist, can be carried only to a certain extent. As the density and strength of the web material is reduced much lower than the levels cited, uncertainties in the magnitude of frictional forces in the winding apparatus and other factors which change during the course of winding a roll make precise nip loading control very difficult. Alternatively, loss of control of the winding process can result in a reversal in tension gradient that can lead to the starring and core slippage problems described above.

In conventional nip winding, the reel spool is pressed into engagement with the reel drum by a pair of hydraulic actuators. Strain gage type sensors are mounted on the hydraulic actuators to sense the amount of strain in the actuators, which is then used to determine the nip load between the reel drum and growing paper roll. Although such an arrangement may be preferable because of the attendant advantages of nip winding (i.e., obtaining a sufficiently high tension in the wound paper), it has been difficult to accurately maintain and control the nip load (which is very important for the reasons presented above). The limits of conventional strain gage sensors and uncertainties in the frictional forces of the apparatus (such as, for example, variations in the sliding friction of the hydraulic actuators or associated carriages for moving the reel spool) have imposed limits on the accuracy of the nip loading, which in turn places limits on the quality and size of the parent rolls and types of paper which can be wound. Efforts to address these problems have been made for improving the accuracy of nip load control during a change-over procedure, as described in published PCT Application WO 97/22543 by Olsson. Olsson attempts to improve nip load control during a change-over, when a new reel spool is moved into position and the paper begins to be wound onto the new spool, by locating force-sensing devices on the primary and secondary arms in an attempt to directly measure the nip load during the change-over. However, Olsson does not address the problem of accurately controlling nip load during a winding operation, in which, particularly for soft paper grades such as tissue, the indentation of the drum into the roll for a given nip load is constantly changing as the thickness of the paper on the roll builds. A nip load control scheme that may be useful during a change-over procedure may not be optimum for a winding operation.

Accordingly, there is a need in the industry for winding apparatus which can be used for various grades of paper, including soft and delicate grades of paper like tissue. Such an apparatus should afford the advantages of nip winding but also provide accurate and effective nip loading so that the quality and size of the parent rolls can be improved.

SUMMARY OF THE INVENTION

The above-noted and other needs are met by the apparatus and method according to one preferred embodiment of the present invention which includes a rotatably mounted reel spool onto which the web of paper material is to be wound to form a roll of increasing diameter, and a reel drum rotatably mounted adjacent to the reel spool. A carriage supports one of the reel drum and the reel spool so as to be movable relative to the other and positions the one of the reel drum and the reel spool adjacent to the other such that a nip is formed therebetween. The carriage maintains the reel drum in contact with the building paper roll as the web of paper is wound. An actuator connected to the carriage is operable for moving the carriage to urge the reel drum and the reel spool relatively toward each other so as to cause the reel drum to apply a linear nip load to the roll of paper and thereby locally indent the paper roll radially inward at the nip.

For a given paper type, there will be a correlation between the radial thickness of a roll of the paper, the radial indentation of the roll by the reel drum, and the linear nip load. In accordance with the invention, for optimum paper roll quality, the radial indentation can be varied from zero to a predetermined value, which can be empirically derived and can be a function of the radial thickness of the paper roll. For instance, when the paper roll is just beginning to be formed, there are only a few layers of paper on the reel spool, and accordingly a desired indentation may be nearly zero, corresponding to a desired nip load that is nearly zero. As the paper roll builds in thickness, an indentation of greater magnitude may be desired for controlling the dimensional stability and quality of the paper roll.

Thus, for example, in accordance with one preferred embodiment of the invention, the controller can be programmed to control the relative positions of the reel spool and reel drum by programming a desired indentation as a function of the radial thickness of the roll. A sensor unit is used to measure parameters from which the radial thickness of the roll and the radial indentation can be inferred. Accordingly, the paper winding parameters are greatly improved and the variabilities in properties of an unwound paper roll can be minimized.

In one preferred embodiment of the invention, the sensor unit preferably comprises a first sensor providing a signal indicative of the relative positions of the reel drum and reel spool, and a second sensor providing a signal indicative of an unindented radial thickness of the paper roll spaced from the nip. The indentation is determined by comparing the signals from the two sensors. Various types of optical, acoustic, and/or electromagnetic sensors may be used, including laser distance or linear displacement measuring devices, ultrasonic distance or linear displacement measuring devices, and/or magnetostrictive linear displacement measuring devices. The indentation is used as a control parameter for controlling positioning of the reel spool relative to the reel drum so that the actual indentation is within a set tolerance of the desired indentation.

A variation on this concept in accordance with an alternative embodiment of the invention is to measure a force exerted between the reel spool and reel drum, which force is proportional to the linear nip load, and to use this force and the radial thickness or diameter of the roll for controlling the positioning of the reel spool relative to the reel drum. For a given paper grade, the linear nip load, indentation, and radial thickness or diameter of the roll are all interrelated. Accordingly, the determination of any two of these parameters also determines the third one. Thus, in the first embodiment described above, the indentation is controlled as a function of radial thickness of the roll, thereby controlling the linear nip load as a function of radial thickness. Alternatively, in accordance with a second preferred embodiment of the invention, a force proportional to linear nip load is controlled as a function of the radial thickness or diameter of the paper roll, thereby controlling indentation as a function of radial thickness or diameter of the roll.

Various types of force-sensing elements can be used for measuring a force that is proportional to or indicative of the linear nip load. For instance, another preferred embodiment of the invention includes a resilient element arranged such that the force applied to the carriage to create the linear nip load causes the resilient element to measurably deform. Advantageously, the resilient element comprises a spring or load cell. Where the carriage movably supports the reel spool and the reel drum is stationary, the spring or load cell is connected between the carriage and the reel spool; alternatively, where the carriage movably supports the reel drum and the reel spool is stationary, the spring or load cell is connected between the carriage and the reel drum. Varying the nip load results in varying deformation of the spring or load cell, and this deformation is sensed and used along with the radial thickness or diameter of the paper roll for controlling movement of the carriage so as to control the nip load.

Parent rolls wound on a winder in accordance with this invention have an internal pressure distribution such that the peak pressure at the core region reaches values lower than those attained from a conventional reel, yet which are sufficient to maintain the mechanical stability required for normal handling. The parent rolls from the method of this invention have an internal pressure near the core which decreases to a certain level and then displays a significant region with an essentially flat pressure profile, except for the inevitable drop to low pressure at the outer surface of the roll. Thus, the uniformity of sheet properties throughout the parent roll is substantially improved.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
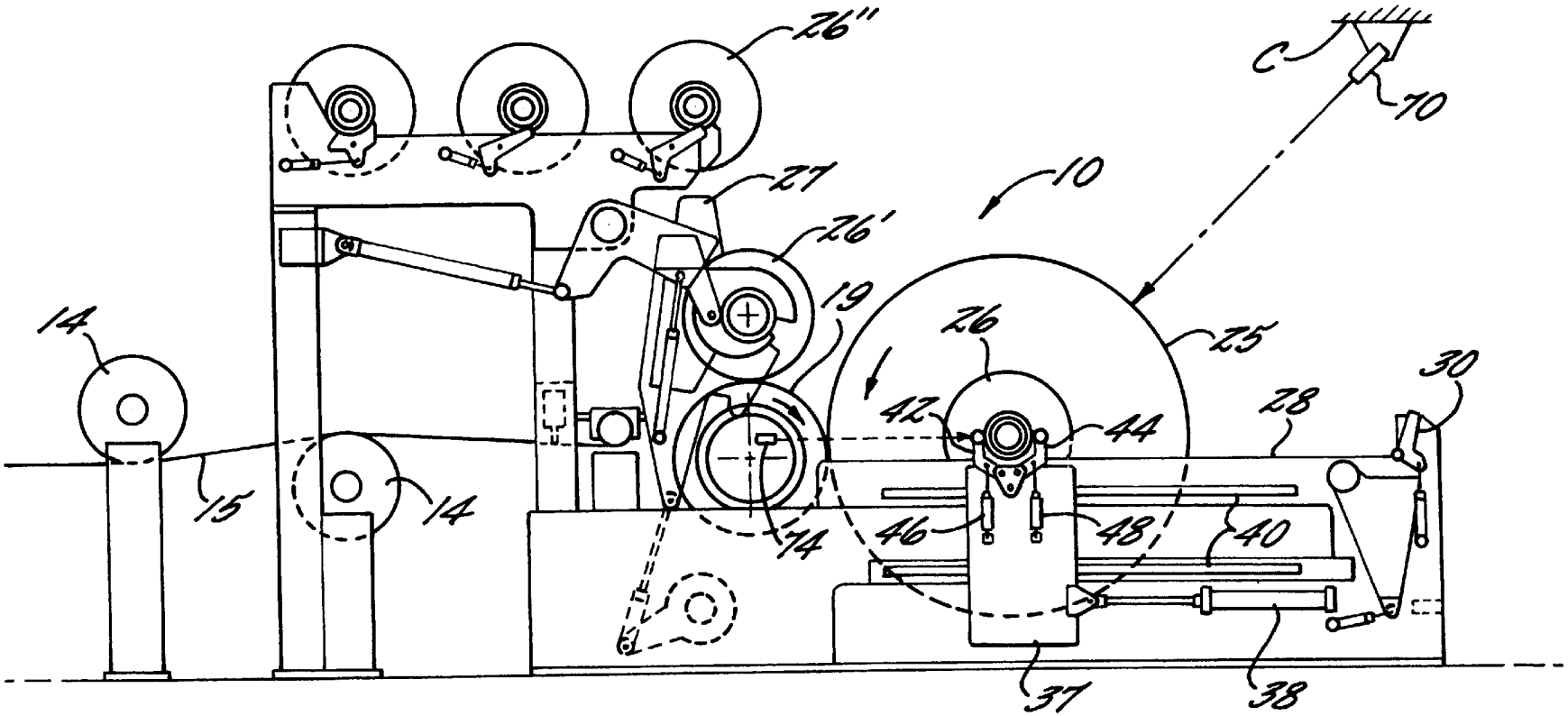
FIG. 1 is a side elevational view of a winding apparatus in accordance with a first preferred embodiment of the present invention, which includes sensors for measuring the unindented and indented radial thicknesses or diameters of the paper roll for inferring the radial indentation of the roll.

A winding apparatus 10 for a papermaking machine according to a first preferred embodiment of the present invention is illustrated in FIG. 1. A dried paper sheet 15 is formed on a conventional papermaking machine and advanced to the winding apparatus 10. It should be understood that the present invention could be used with either creped or uncreped papermaking machines. Also, although the present invention is probably most preferable for winding tissue grades of paper, the invention could also be used with other grades. The sheet 15 is advanced through a pair of guide rolls 14 and over a reel drum 19 to a reel spool 26 which is driven by a center drive motor (not shown) acting on the shaft of the reel spool. Winding of paper onto the reel spool begins while the reel spool is in a pair of primary arms 27 as indicated by the reel spool 26' shown in an upper position above the reel drum 19. Reference numbers 26, 26' and 26" illustrate three positions of the reel spools during the operation. As shown, a new reel spool 26' is ready to advance to the winding position as the parent roll 25 is building. When the parent roll 25 has reached its final predetermined diameter, the new reel spool 26' is lowered by the primary arms 27 into position against the rotatable reel drum 19. The paper web 15 preferably, but not necessarily, is transferred from the fully wound reel spool 26 to the new reel spool 26' while the new reel spool is in the upper position shown in FIG. 1, and the paper web is severed from the parent roll 25 and winding of the web onto the new reel spool 26' begins. The completed parent roll 25 and reel spool 26 are then kicked downstream along a pair of rails 28 until the reel spool 26 reaches stops 30. The new reel spool 26' is lowered to a winding position where it is generally on the same horizontal level as the reel drum 19, i.e., so that the new reel spool 26' occupies the position previously occupied by the completed reel spool 26.

The winding of paper onto the reel spool 26 in the winding position is conducted with the reel spool 26 held in a pair of secondary arms 42 and 44 movably mounted on each of two secondary carriages 37 (only one visible in FIG. 1) on opposite ends of the reel spool 26. The carriages 37 are horizontally slidable along a system of rails 40 so that the carriages can be moved toward and away from the reel drum 19. A hydraulic actuator 38 is connected to each of the carriages 37 for imparting horizontal movement to the carriage 37 so as to move the reel spool 26 toward and away from the reel drum 19. In particular, as the parent roll 25 builds, the actuators 38 are operated to move the reel spool 26 away from the reel drum 19 such that the nip load exerted on the parent roll 25 by the reel drum 19 is controlled in a desired fashion.

Figure 2:
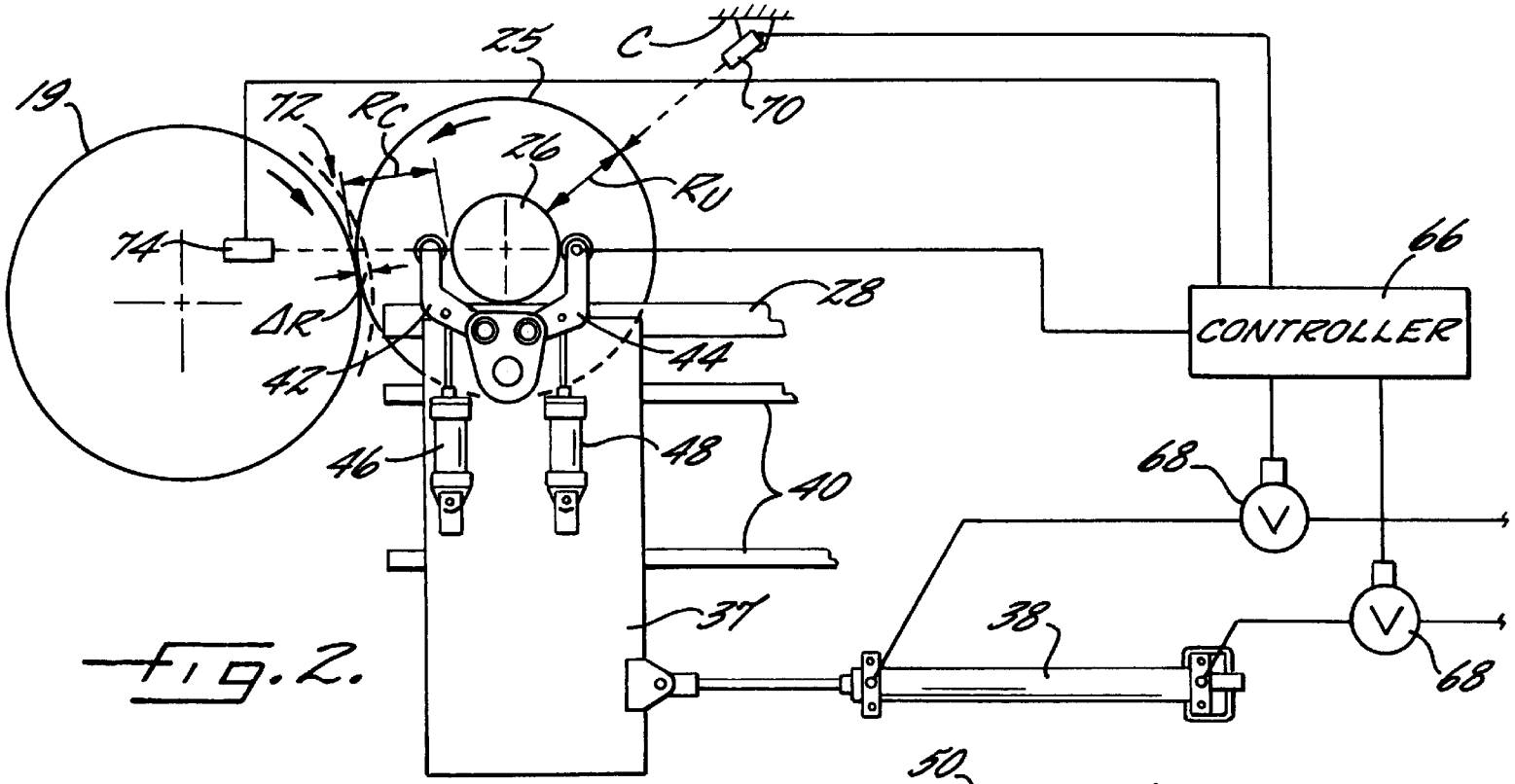
FIG. 2 is a schematic side elevational view of the reel drum, reel spool, and carriage of the apparatus of FIG. 1, illustrating the measurement of the unindented and indented thicknesses of the paper roll, and also showing a controller and valves for controlling operation of the actuator that moves the carriage relative to the reel drum.

FIG. 2 depicts in greater detail the components of the system for controlling the movement of the carriages 37 in accordance with the first preferred embodiment of the invention. The description of one of the carriages 37 and control system will be given, it being understood that the other carriage also includes a similar system for controlling the carriage's movement. As noted above, the carriage 37 is movable on horizontal rails 40 which are schematically depicted. The carriage pivotally supports a pair of arms 42 and 44. The upstream arm 42 is pivotally moved by an actuator 46 connected between the arm and the carriage 37. Similarly, the downstream arm 44 is pivotally moved by an actuator 48 connected between the arm and the carriage. The upstream arm 42 is essentially inoperative during the winding process, but is operated after the parent roll 25 is finished winding so as to kick the completed roll 25 and reel spool 26 downstream along the rails 28 to the stops 30 (FIG. 1). The downstream arm 44 functions during the winding process to prevent the parent roll 25 and reel spool 26 from moving away from the reel drum 19.

In order to control the indentation of the paper roll 25 and nip load during the winding process, the apparatus includes sensors for sensing the radial indentation of the paper roll at the nip and signals from the sensors are used for controlling the movement of the carriage so as to control the indentation and nip load. Thus, a first sensor 70 is suitably mounted, for example to a ceiling C of a building housing the apparatus, for sensing the unindented radial thickness $R_u$ of the parent roll 25 in an unindented region of the roll spaced from the nip 72. The unindented radial thickness $R_u$ may be determined in various ways, for example by sensing a distance from the sensor 70 to the surface of the roll 25 and subtracting that distance from a known distance between the sensor 70 and the surface of the reel spool 26. A second sensor 74 is suitably mounted for sensing the indented radial thickness $R_c$ of the parent roll 25 at the nip 72. The indented thickness $R_c$ is directly related to the relative positions of the reel drum 19 and reel spool 26 and thus may be determined by sensing the relative positions in various ways; for example, the sensor 74 may sense the distance between the centers of the reel drum 19 and reel spool 26, or the distance between the center of one and the surface of the other, etc., any of which can be used to derive the indented radial thickness $R_c$. Alternatively, a position sensor can be built into or otherwise connected to the hydraulic actuator 38 that moves the carriage 37, and the position of the carriage indicated by such sensor can be used for inferring the indented radial thickness $R_c$.

The sensors 70 and 74 are connected to a controller 66. The controller is programmed to determine a radial indentation $\Delta R$ of the parent roll 25 based on the signals received from the sensors 70, 74. The controller operates valves 68 to control the actuator 38 so as to maintain the radial indentation $\Delta R$ within predetermined limits. The predetermined limits may be a function of the known compressibility of the paper web 15, the indented radial thickness $R_c$ of the parent roll 25, as well as other parameters.

The reel drum 19 may be modeled as substantially incompressible. In other instances, it may be desirable to use a reel drum 19 with a known, finite compressibility (which is typically much less than the compressibility of the paper roll) and the compressibility of the reel drum can also be a parameter in determining the proper position of the actuator 38 to provide the desired nip load.

If desired, the actual nip load can be continuously calculated based on the instantaneous values for the positions of the reel drum 19 and reel spool 26, the unindented radial thickness $R_u$ of the paper on the roll, and the compressibility of the paper and/or the reel drum. It is not necessary to continuously calculate the actual nip load, however, and reasonable accuracy can be obtained more inexpensively by merely programming the controller with a look-up table where a direct relationship is made between the sensed radial indentation $\Delta R$ and the desired hydraulic actuator position.

Various types of sensors 70, 74 may be used, including: laser-based distance or depth sensing devices using techniques such as laser triangulation; laser white light or multiple wavelength moire interferometry, as illustrated by Kevin Harding, "Moire Interferometry for Industrial Inspection," *Lasers and Applications, November* 1993, pp. 73–78, and Albert J. Boehnlein, "Field Shift Moire System," U.S. Pat. No. 5,069,548, Dec. 3, 1991; ultrasonic sensing, including methods described in L. C. Lynnworth, *Ultrasonic Measurements for Process Control,* Academic Press, Boston, 1989, and particularly the method of measuring the delay time for an ultrasonic signal reflected off a solid surface; microwave and radar wave reflectance methods; capacitance methods for determination of distance; eddy current transducer methods; single-camera stereoscopic imaging for depth sensing, as illustrated by T. Lippert, "Radial parallax binocular 3D imaging" in Display System Optics II, Proc. SPIE Vol. 1117, pp. 52–55 (1989); multiple-camera stereoscopic imaging for depth sensing, as illustrated by N. Alvertos, "Integration of Stereo Camera Geometries" in Optics, Illumination and Image Sensing for Machine Vision IV., Proc. SPIE, Vol. 1194, pp. 276–286 (1989); contacting probes such as rollers, wheels, metal strips, and other devices whose position or deflection is measured directly; and the like.

As previously noted, it is also possible to incorporate a position or linear displacement sensor within or adjacent to the actuator 38 such that the position of the carriage 37 or the length of linear movement of the carriage 37 can be sensed and converted into an indented radial thickness of the paper roll. For example, a magnetostrictive position sensor, such as a TEMPOSONICS sensor available from MTS Systems Corporation of Research Triangle Park, North Carolina, can be used for sensing the carriage position. However, the invention is not limited to any particular type of sensor.

Figure 3:
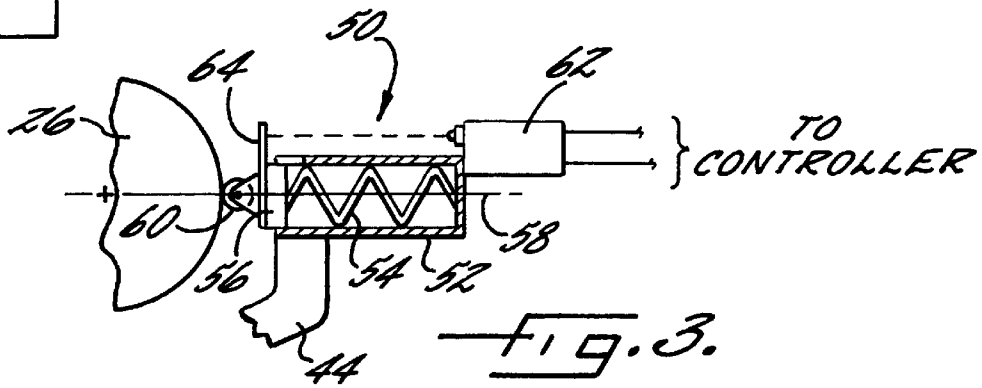
FIG. 3 is an enlarged cross-sectional view of a resilient element for sensing a force proportional to or indicative of a linear nip load in accordance with a second preferred embodiment of the invention in which the force is used for controlling the indentation and nip load as a function of radial thickness or diameter of the paper roll.

With reference to FIG. 3, a second preferred embodiment of the invention is depicted, in which a force-sensing element 50 is used for sensing a force exerted on the reel spool 26 by the arm 44. In this embodiment of the invention, instead of sensing indentation directly and using the sensed indentation together with the radial thickness of the roll for controlling carriage movement, the force measured by force sensor 50 is used together with a sensed radial thickness or diameter of the paper roll for controlling carriage movement.

Thus, the downstream arm 44 supports a resilient element 50 which contacts the reel spool 26. The resilient element in the illustrated embodiment comprises a housing or cylinder 52 within which is mounted a compression coil spring 54, although other types of springs could be used. A piston 56 is attached to the end of the spring 54 adjacent an open end of the cylinder 52. The piston 56 is slidably mounted within the cylinder. The cylinder 52 is mounted to the arm 44 with the axis 58 of the cylinder oriented generally along a radius of the reel spool 26. A roller or wheel 60 is rotatably mounted on the piston 56 for rolling contact with the reel spool 26.

Thus, it will be appreciated that force exerted between the arm 44 and the reel spool 26 is transmitted through the resilient element 50 and along the axis thereof. Accordingly, the force tends to compress the spring 54 within the cylinder 52, a greater force causing greater deformation of the spring 52 and a lesser force causing lesser deformation of the spring. The spring has a known spring constant and thus the length of the spring 52 is a measure of the force exerted between the arm 44 and the reel spool 26, and therefore is proportional to or indicative of the linear nip load applied between the parent roll 25 and the reel drum 19.

A distance measuring device 62 is mounted adjacent to the resilient element 50 for sensing the length of the spring 54. While the measuring device 62 is shown as being affixed to the housing 52, it may alternatively be affixed to another structure such as a wall or ceiling of an enclosure housing the winder 10. Preferably, but not necessarily, the distance measuring device 62 comprises a laser displacement sensor, and a mirror 64 is mounted on the piston 56 for reflecting laser light back to the sensor 62. Other types of distance measuring devices may alternatively be used, including any of the types of devices listed above.

The sensor 62 is connected to a controller 66 which in turn is connected to a pair of valves 68 (FIG. 2) which are coupled to the hydraulic actuator 38. The controller 66 is programmed to operate the valves 68 based on signals received from the sensor 62 so as to maintain the force indicated by the sensor 62 within predetermined limits.

In accordance with the invention, it is recognized that improved paper qualities are obtained, particularly with soft paper grades such a tissue, by controlling the winding such that linear nip load is not constant but rather so that the nip load varies as a function of the radial thickness of the building paper roll. Accordingly, the set point for the force indicated by the sensor 62 advantageously is a function of the radial thickness or diameter of the paper roll 25. To this end, the winding apparatus in accordance with the second embodiment preferably includes a position sensor or distance-measuring device for sensing the radial thickness or diameter of the roll. Any of the types of sensors previously noted can be used for sensing the radial thickness or diameter of the roll. Additionally, it will be appreciated that the force-sensing element 50 essentially comprises a load cell, and thus other types of load cells can be used in its place if desired. For example, a KOSD-40 or KISD-8 load cell available from Nobel Electronik AB of Karlskoga, Sweden, can be incorporated into the shaft of the roller 60 that urges against the reel spool.

Figure 4:
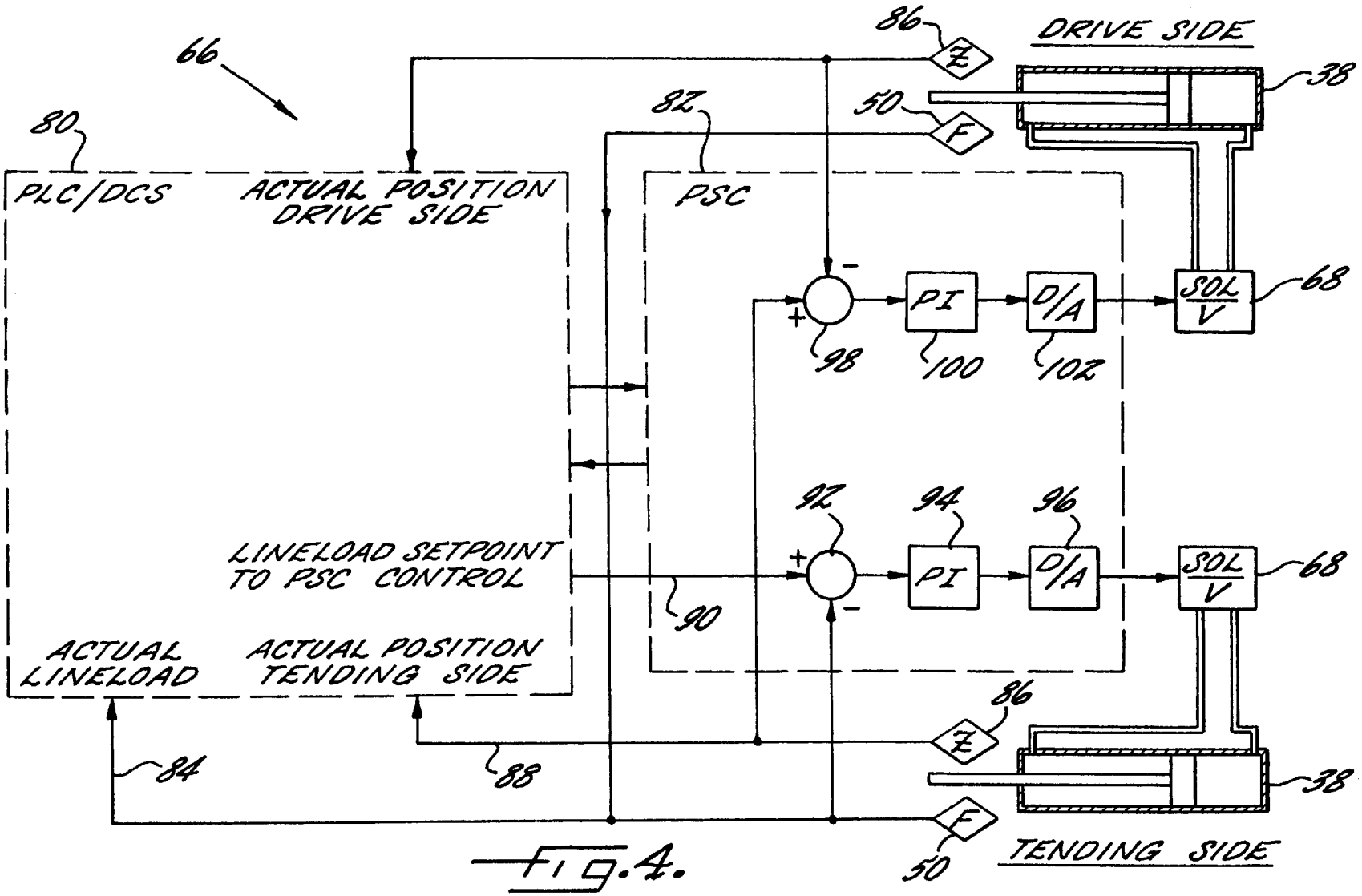
FIG. 4 is a control diagram depicting a control system for controlling the positions of the tending-side and drive-side carriages of a secondary winding system of a winding apparatus in accordance with the second preferred embodiment of the invention.

FIG. 4 depicts a control system for controlling the hydraulic actuators 38 in accordance with the second embodiment of the invention. Control system components are shown for both tending-side and drive-side carriages. A controller 66 comprises a programmable logic controller and/or computer 80 for calculating a set point value for the force exerted on the force-sensing elements or load cells 50, and a controller 82 for operating the valves 68 such that the hydraulic actuators 38 move the tending-side carriage to drive the error between the actual force indicated by the tending-side load cell 50 and the set point value toward zero. Thus, an actual force or "lineload" is communicated from the tending-side load cell 50 to the set-point controller 80 as indicated at 84. Alternatively, the "actual" lineload can be the average of the forces indicated by the tending- and drive-side load cells. It will be appreciated that the force indicated by the load cell 50 will be generally proportional to the linear nip load, but in many cases will not be identical to the nip load for a variety of reasons. For instance, the roller 60 may contact the reel spool at a point that is not aligned with the radial line passing from the center of the paper roll 25 through the contact point between the paper roll and the reel drum 19.

As noted above, the set point for the lineload advantageously is a function of the radial thickness or diameter of the paper roll, and is preferably calculated by the controller based on a predetermined correlation between lineload and roll diameter. For example, the controller can be programmed with a look-up table or the like for determining lineload set point based on a sensed diameter of the roll. It will be appreciated that the predetermined correlation will generally be different for different paper grades, and may be influenced by other factors as well. Accordingly, a position sensor 86 is built into or connected with each hydraulic actuator 38. The diameter of the paper roll is a function of the position of the carriage, and thus the signal from the position sensor 86 is indicative of the diameter of the roll. This position signal is fed to the set-point controller 80 as indicated at 88. The set-point controller 80 calculates a set point for the lineload and communicates the set point to the controller 82 as indicated at 90. An error between the set point and the actual lineload is determined by the controller 82 at 92, and the error signal is fed to a proportional integral control 94, which generates a correction signal for driving the lineload error toward zero. The correction signal is sent through a digital-to-analog converter 96 and the converted analog signal is fed to the valves 68 for the tending-side actuator 38, and the valves are accordingly opened or closed by an incremental amount to operate the actuator 38 so as to incrementally move the tending-side carriage to increase or decrease the lineload toward the set point value.

On the drive side of the apparatus, position control is used so as to maintain the position of the drive-side carriage essentially the same as that of the tending-side carriage. Thus, an error between the actual position from the tending-side position sensor 86 and the actual position from the drive-side position sensor 86 is determined within the controller 82 as indicated at 98, and the error signal is fed to a proportional integral controller 100, which generates a correction signal for the drive-side actuator 38. The correction signal is sent to a digital-to-analog converter 102, which supplies an analog correction signal to the valves 68 for the drive-side actuator 38 so as to drive the position error toward zero.

While position control is used for the drive-side carriage to maintain the reel spool 26 parallel to the reel drum 19 throughout the winding operation, at the very start of winding when a new reel spool is in the upper position (indicated by reel spool 26' in FIG. 1) and the tail of the paper web is wrapped onto the new reel spool to begin winding paper onto the reel spool, preferably the controller is programmed to position one end of the reel spool closer to the reel drum than the other end. Positioning the reel spool in this manner facilitates the winding of the tail onto the spool. For example, one end of the reel spool can be placed about 20 mm closer to the reel drum than the other end of the reel spool.

When the winding of paper onto the reel spool 26 starts with the reel spool in the upper position indicated at 26' in FIG. 1, control of the nip load in that position may be difficult if the methods of the present invention are used, because the paper layers are still quite thin and hence do not permit a substantial degree of indentation. Accordingly, control of the winding process in the upper position may be effected through another method, such as conventional nip load control with strain gage or other force sensors, until the paper layers on the reel spool are thick enough to permit the methods of the present invention to be employed, at which time control of the nip load in accordance with the methods of the invention may be commenced.

From the foregoing description of certain preferred embodiments of the invention, it will be appreciated that the invention provides apparatus and methods for controlling the linear nip load in a paper winder which facilitate accurate control of the nip load even at low levels thereof.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. In addition, although specific terms are employed herein, they are used in a generic and descriptive sense only and not for purposes of limitation.

What is claimed is:

1. An apparatus for winding a web of paper material into a roll, the apparatus comprising:

a rotatably mounted reel spool onto which the web of paper material is to be wound to form a roll of increasing diameter;

a reel drum rotatably mounted adjacent to the reel spool;

a carriage supporting one of the reel drum and the reel spool so as to be movable relative to the other and positioning said one of the reel drum and the reel spool adjacent to the other such that a nip is formed therebetween;

an actuator connected to the carriage and operable for moving the carriage to urge the reel drum and the reel spool relatively toward each other so as to cause the reel drum to indent the roll of paper radially inward locally at the nip;

a sensor unit which provides a signal indicative of the radial indentation of the reel drum into the roll of paper; and a controller connected to the sensor unit and to the actuator and operable for controlling the actuator to move the carriage so as to maintain within predetermined limits the amount of radially inward indentation of the reel drum into the paper roll at the nip.

2. An apparatus according to claim 1, wherein the sensor unit includes a sensor operable to sense a diameter of the paper roll, and wherein the controller is programmed to determine and adjust the limits for the indentation based on the sensed diameter of the paper roll.

3. An apparatus according to claim 1, wherein the sensor unit includes a first sensor providing a signal as a function of an indented radial thickness of the paper roll at the nip, and a second sensor providing a signal as a function of an unindented radial thickness of the paper roll in an unindented region thereof.

4. An apparatus according to claim 3, wherein the controller receives the signals from the first and second sensors and is operative to calculate the amount of indentation of the reel drum into the paper roll.

5. An apparatus according to claim 3, wherein the second sensor is a laser measuring device.

6. An apparatus according to claim 3, wherein the second sensor is an ultrasonic measuring device.

7. An apparatus according to claim 1, wherein the sensor unit includes:

a first position sensor providing a signal indicative of an unindented thickness of the roll of paper;

a second position sensor providing a signal indicative of a position of the carriage as the paper web is being wound to form the roll; and wherein the controller receives the signals from the first and second sensors and calculates the amount of indentation of the reel drum into the roll of paper based on said signals.

8. An apparatus according to claim 7, wherein the second position sensor is a magnetostrictive linear displacement sensor.

9. An apparatus according to claim 7, wherein the second position sensor is a deformable element.

10. An apparatus according to claim 1, wherein the reel drum is substantially incompressible.

11. An apparatus according to claim 1, wherein the reel drum has a predetermined compressibility.

12. An apparatus according to claim 1, wherein the carriage movably positions the reel spool and the reel drum remains stationary.

13. A method of winding a web of paper material into a roll, the method comprising:

positioning one of a reel drum and a reel spool adjacent to the other such that a nip is formed therebetween;

rotating the reel drum and the reel spool so that the web of paper material is wound on the reel spool to form a paper roll of increasing diameter;

applying a force to one of the reel drum and reel spool such that the reel drum is indented into the roll adjacent the nip;

sensing the indentation of the reel drum into the paper roll; and adjusting the position of the one of the reel drum and reel spool and the force applied to the one of the reel drum and reel spool to maintain within predetermined limits the indentation of the reel drum into the paper roll as the paper roll increases in diameter.

14. A method according to claim 13, further comprising the step of calculating a linear nip load applied to the paper roll based on a predetermined compressibility of the roll and the indentation of the roll.

15. A method according to claim 14, wherein the calculating step further comprises calculating the linear nip load based on the compressibility of the roll and a predetermined compressibility of the reel drum.

16. A method according to claim 13, wherein said positioning step further comprises positioning only the reel spool and maintaining the reel drum stationary.

17. A method according to claim 13, further comprising sensing a diameter of the paper roll, and wherein the adjusting step comprises using a predetermined correlation between indentation and diameter of the paper roll to control the position of the one of the reel drum and reel spool so as maintain the indentation within a selected tolerance of the correlation.

18. A method of winding a web of paper material into a roll, the method comprising:

positioning a mechanism engaging one of a reel drum and reel spool such that a nip is formed between the reel drum and the reel spool;

rotating the reel drum and the reel spool so that the web of paper material is wound on the reel spool to form a paper roll of increasing diameter;

using the mechanism to apply a force to the one of the reel drum and reel spool so as to create a linear nip load between the reel drum and the reel spool and cause the reel drum to indent the paper roll at the nip;

sensing the force applied by the mechanism to the one of the reel spool and reel drum;

sensing a diameter of the paper roll;

determining limits for the sensed force based on the sensed diameter and a predetermined correlation between force and diameter of the paper roll; and adjusting the position of the mechanism so as to maintain the sensed force within said limits, thereby controlling the linear nip load and indentation of the paper roll at the nip as a function of diameter of the paper roll.

19. A method according to claim 18, wherein the force-sensing step comprises sensing the deformation of a deformable element connected between the mechanism and the one of the reel drum and reel spool, and determining force based on said deformation.

20. A method according to claim 19, wherein the step of sensing the deformation comprises sensing the indentation of the paper roll.

21. A method according to claim 20, wherein the indentation of the reel drum into the roll of paper is sensed by sensing relative positions of the reel drum and reel spool and determining an indented thickness of the roll at the nip based on said relative positions, and sensing an unindented thickness of the roll spaced from the nip.

22. A method according to claim 21, wherein the step of sensing the unindented thickness of the roll comprises using a laser measuring device to sense the unindented thickness.

23. A method according to claim 21, wherein the step of sensing the unindented thickness of the roll comprises using an ultrasonic measuring device to sense the unindented thickness.

24. A method according to claim 21, wherein the step of sensing the relative positions of the reel drum and reel spool comprises sensing a length of movement of the mechanism which positions the one of the reel drum and reel spool.

25. A method according to claim 24, wherein the step of sensing the length of movement of the mechanism comprises using a magnetostrictive linear displacement sensor to sense the length of movement.

26. A method according to claim 18, wherein the step of positioning a mechanism comprises supporting opposite ends of the reel spool by a pair of carriages that are movable toward and away from the reel drum, and positioning the carriages such that the reel spool is generally parallel to the reel drum, wherein the step of sensing a force comprises sensing a force applied by a first of the carriages on the reel spool in the direction of the reel drum, and wherein the step of adjusting the position comprises adjusting the positions of the carriages such that the reel spool remains generally parallel to the reel drum.

27. A method according to claim 26, wherein the first carriage position is controlled to drive the sensed force applied by the first carriage toward a desired force which is a function of the sensed diameter, and wherein the other carriage position is controlled to drive the other carriage position toward the first carriage position.

* * * * *

UNITED STATES PATENT AND TRADEMARK OFFICE
CERTIFICATE OF CORRECTION

PATENT NO. : 6,036,137

DATED : March 14, 2000

INVENTOR(S) : Myren

It is certified that error appears in the above-identified patent and that said Letters Patent is hereby corrected as shown below:

Title page, item [75], in the Inventor's address, "Switzerland" should read --Sweden--.

Title page, [56] References Cited, U.S. PATENT DOCUMENTS, line 6, "Lombardini" should read --Francesco--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*